US005171627A

United States Patent [19]

Brockington et al.

[11] Patent Number: 5,171,627

[45] Date of Patent: Dec. 15, 1992

[54] PROCESS FOR FABRICATING A PRECURSOR SHEET, PARTICULARLY AS BOOK COVER STOCK AND PRODUCT PRODUCED THEREBY

[75] Inventors: Francis R. Brockington, Columbia, S.C.; Charles E. Snyder, Beaver Falls, N.Y.; Vance E. Gentry, Jonesboro, Tenn.

[73] Assignee: The Lincoln Group, Inc., Lincoln, R.I.

[21] Appl. No.: 589,199

[22] Filed: Sep. 27, 1990

[51] Int. Cl.[5] ..... B32B 9/00

[52] U.S. Cl. ..... 428/220; 428/537.5; 428/542.8

[58] Field of Search ..... 428/220, 542.8, 537.5

[56] References Cited

U.S. PATENT DOCUMENTS 4,208,459 6/1980 Becker et al. ..... 428/220
4,888,092 12/1989 Prusas et al. ..... 428/537.5

FOREIGN PATENT DOCUMENTS 0668815 8/1963 Canada ..... 117/203
0098498 6/1983 Japan ..... 428/537.5

*Primary Examiner*—Patrick J. Ryan
*Assistant Examiner*—Kam T. Lee
*Attorney, Agent, or Firm*—Louis E. Marn

[57] ABSTRACT

There is disclosed a process for impregnating a sheet of wood-based unbleached virgin fibers comprised of 20 to 95 parts of hardwood fibers and 80 to 5 parts of softwood fibers with a saturant having a $T_G$ of from 5% to −50° C. and comprising of from 5 to 50 percent by weight dry basis of a resulting dried sheet wherein the hardwood and softwood fibers are produced by chemical pulping of hardwoods and softwoods.

9 Claims, 1 Drawing Sheet

PROCESS FOR FABRICATING A PRECURSOR SHEET, PARTICULARLY AS BOOK COVER STOCK AND PRODUCT PRODUCED THEREBY

BACKGROUND OF THE INVENTION

1. Field of the Invention

This invention relates to the fabrication of cellulosic sheets, and more particularly to a process for the fabrication of book cover stock from an admixture of wood-based cellulosic fibers obtained by the chemical pulping of hardwoods and softwoods and the product produced thereby.

2. Description of Prior Art

In the manufacture of bookcovering materials, such as for menu covers, presentation folders, pocket appointment calendar covers and like materials, the base material is a mixture of natural fibers, such as cotton fibers and cellulosic fibers obtained by chemical pulping techniques impregnated with a saturant, such as carboxylated SBR resins added to the fiber mixture prior to forming a sheet substrate. Attempts to prepare sheets solely of like hard and strength qualities from natural fibers containing mixtures of wood-based cellulosic fibers have been unsuccessful due to the required use of long fibers for strength which is inconsistent with requirements of smoothness and uniformity.

Generally, book cover stock is formed on a paper making machine having a cylinder headbox using combined highly refined bleached pulp and cotton fibers (or rag) of up to 80 percent wherein the blended pulp is comprised of not less than about 50 percent long fiber. Refining or fibrillation is required in order to obtain the desired levels of smoothness since softwood fibers are longer and of larger diameter than hardwood fibers. Saturant or resin is added in an amount of from about 20 to 50% by weight with precoating applied to one or both sides of the resulting sheet prior to calendering. The numerous processing steps and concomitant expense of raw materials result in costly product lacking cross-sectional uniformity, exhibiting non-uniform coating capabilities and the like as a result of a high content of long fibers.

OBJECTS OF THE INVENTION

It is an object of the present invention to provide a precursor sheet of substantially an all wood-based fiber system for book cover stock of greater uniformity.

Another object of the present invention is to provide an improved process for producing a precursor sheet of substantially an all wood-based fiber system for book cover stock sheets.

A further object of the present invention is to provide an improved process for producing a precursor sheet of substantially an all wood-based fiber system for book cover stock of greater uniformity.

A still further object of the present invention is to provide an improved process for producing a precursor sheet of substantially an all wood-based fiber system for book cover stock of improved uniformity.

Still another object of the present invention is to provide an improved process for producing a precursor sheet of substantially an all wood-based fiber system for book cover stock of improved hardness and strength characteristics.

SUMMARY OF THE INVENTION

These and other objects of the present invention are achieved in one embodiment by impregnating a sheet of wood-based unbleached virgin fibers comprised of 20 to 95 parts of hardwood fibers and 80 to 5 parts of softwood fibers with a saturant having a $T_G$ of from 5° C. to −50° C. and comprising of from 5 to 50 percent by weight dry basis of a resulting dried sheet wherein the hardwood and softwood fibers are produced by the chemical pulping of hardwoods and softwoods as well as the product produced thereby.

BRIEF DESCRIPTION OF THE DRAWING

A better understanding of the present invention will be appreciated from the following detailed description when taken with the accompanying schematic flow diagram FIGS. 1 and 2.

DETAILED DESCRIPTION OF THE INVENTION

Figure 1:
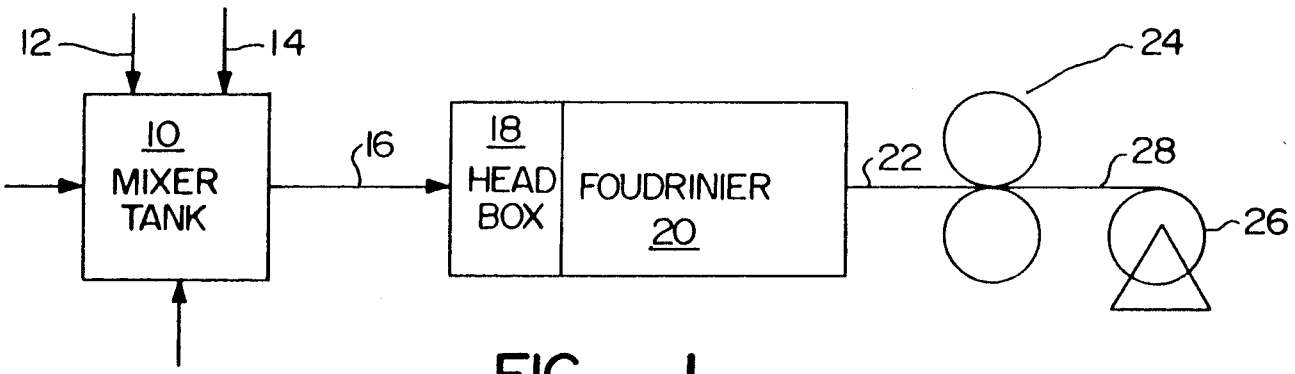
Figure 2:
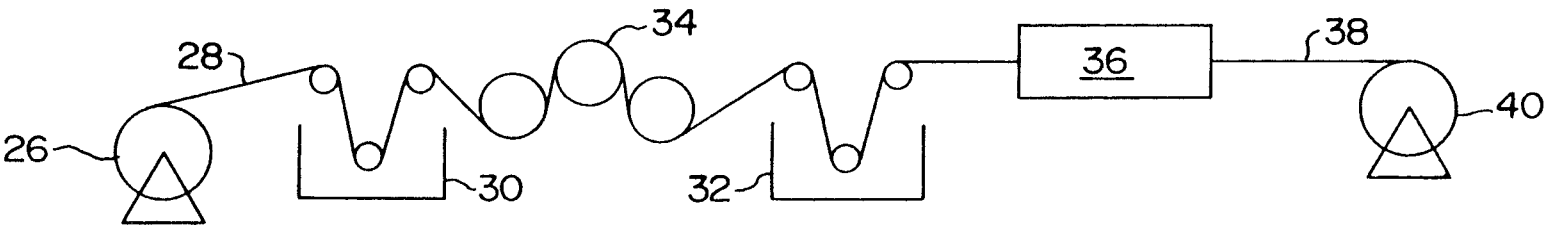

Referring now to the drawing, there is provided a mixing tank 10 for admixing unbleached hardwood pulp in line 12 and unbleached softwood pulp in line 14 to form a substantially all wood-based pulp stream in line 16. The combined pulp stream in line 16 is comprised of from 20 to 95 parts of unbleached hardwood pulp to 80 to 5 parts of softwood pulp, preferably 70 to 95 and 30 to 5, respectively. Unbleached pulp is obtained by the chemical pulping, preferably by sodium-based Kraft pulping techniques. The combined pulp stream 16 is introduced into a headbox 18 of a paper machine 20, such as a Foudrinier paper making machine to form a sheet 22. The sheet 22 is introduced into drying rollers, generally indicated as 24 to form a dried sheet 28 having a basis weight of from 80 to 300 lbs. per 3,000 $ft^2$ at a weight deviation of ±5 percent in a machine direction. The dried sheet 28 is taken up on a roller 26 as book cover stock.

The hardwood pulp in line 12 comprises fibers having a fiber length of from 1.4 to 1.9 mm. with a concomitant diameter of from 14 to 40 um and are produced by the chemical pulping of a hardwood selected from the group consisting of gums, oaks, such as red and white oaks and mixtures thereof. Of the gums, there is sweet gum (*Liquidambar Styraciflua L.*), black gum (*Nyssa Sylvatica Marsh.*) and tupelo (*Nyssa Aquatica L.*) of the oaks, there are red (*Quercus Falcata Michx*), scarlet (*Quercus Coccinea Muench*), willow (*Quercus Phellos L.*), water (*Quercus Nigra L.*) and laurel (*Quercus Laurifolia L.*) Of the white oaks, there are white (*Quercus Alba L.*) and swamp chestnut (*Quercus Michauxii nutt*). Minor amounts of miscellaneous hardwood, such as red maple (*Acer Rubrum*) yellow poplar (*Liriodendron Tulipifera L.*) and hickory (*Carya SPP.*) may be present in the hardwood pulp stream without deleteriously effecting the process nor product of the present invention.

The softwood pulp in line 14 comprises fiber having a fiber length of from 3 to 4.9 mm with a concomitant diameter of from 35 to 45 μm. produced by the chemical pulping of a softwood selected from the group consisting of loblolly pines (*Pinas Saeda L.*), longleaf pine (*Pinas Polastris Mill.*), slash pine (*Pinus Ellisttin Englim*), pond pine (*Pinas Serotina Michx.*) short leaf pine (*Pinas Echinata Mill.*) and mixtures thereof.

Generally, softwood fibers are longer than hardwood fibers with the ratio of hardwood to softwood being selected to provide a stock sheet exhibiting high adsorbency for a saturating material and high uniformity in that the sheet is free from floculants i.e., freed of lumps, contaminants, fiber knots, etc. Additionally, there is need for uniformity in across-the-web basis and caliper. High wet strength is detrimental to quality, and therefore should be minimized, such as by limiting or minimizing fibrillation. The book cover stock sheet 28 suitable for subsequent impregnation with a saturant or saturating medium exhibits physical properties of porosity of less than about 35 seconds, preferably about 15 to 20 seconds, and an apparent density of from 7 to 14, preferably of from 9 to 12.

The saturant or saturating material is selected to provide the book cover precursor sheet with proper strength and flexibility properties of a cured book cover sheet comparable to those achieved by the use of cotton fibers while retaining surface smoothness. In other words, the resulting product provides equivalent mechanical strength with superior surface properties allowing for enhanced surface characteristics.

For book cover stock sheet, the most important property is fold. A test called the MIT fold test has been developed which quantifies the number of times a sheet, under stress, can be folded before it breaks. Poorer quality saturant stocks exhibit an MIT fold of less than 600 while higher quality stocks exhibit an MIT fold in excess of about 4000. In general, polymers that are elastic in contrast to rigid plastics improve the fold properties more effectively.

Often other factors besides the physical properties of the saturant book cover stock determine the preferred choice of saturant. These factors include price of the saturant, residual odor, heat and light stability, bond of subsequent coatings to the saturated sheet, chemical stability, holdout, and process considerations. Process considerations are those factors that influence runnability and include wettability (how fast the saturant penetrates into the sheet), foaming, skimming over, dryability (how easily the polymer releases the water), rewettability (saturant cannot dry out on squeeze rolls and must be rewettable), tackiness (tack level of surface saturant cannot be very high otherwise the web will stick to rolls or drying cans and the finished roll will tend to block), etc. Some saturants are less forgiving of inks and pigments and are to be avoided, if possible. Run to run reproducibility invariably becomes a major production consideration.

Saturants or saturating materials include emulsions of acrylics, vinyl acrylic copolymers, acrylonitrile acrylic copolymers, ethylene vinyl acetates, and various rubber emulsions including carboxylic modified styrene butadiene (SBR), neoprene, styrene butadiene acrylonitrile. Additionally, there are new lattices on the horizon based on Interpenetrating Polymer Network technology (IPN) to bring together traditionally imcompatible systems, such as starch and SBR or starch and vinyl acrylics. Methoyl Acryloamide and other similar curing agents are often included in the polymer backbone to cross-link the polymer upon drying. Specific saturants include B. F. Goodrich Hycar 26092 ($T_G$ −12), Hycar 26083, Hycar 26322 ($T_G$ −15), Hycar 26345 ($T_G$ −6) and Hycar V-43 ($T_G$ −43).

In general, preferred saturants are applied in solid emulsions at 20 to 35% solids. The glass transition temperature ranges from −50 C< for SBR and some very soft acrylics up to 5 C°. for relatively stiff acrylic copolymers. All of the saturants are lattices having a mean particle size of 500 to 3000 microns. The dry weight percent saturant add-on is 5 to 50%, preferably 15 to 40% calculated by dividing the weight of the saturated sheet less the weight of the unsaturated sheet by the weight of the unsaturated sheet times 100. The saturated sheet is dried to less than 5% residual moisture. Saturants that are preferred impart good physical properties to the stock.

The saturant or saturating material, referring again to the drawing, is introduced into vessels 30 and 32 with sheet coursing effected to add-on an amount to provide of from 5 to 50%, preferably about 15 to 40% basis weight of the final book cover precursor sheet. The book cover stock sheet 28 is coursed through the vessels 30 and 32 about coating rollers assembly 34 and passed through drying assembly 36 for collection on roller 40 as book cover precursor sheet 38 having a thickness of from 7 to 30 mils.

As hereinabove described in a preferred embodiment of the present invention, the saturant is impregnated and/or coated onto the unbleached pulp book cover stock sheet, however, it is contemplated that book cover precursor sheet may be formed directly in the paper making machine by admixing the saturant in the mixing tank 10 in line 15 with the unbleached pulp streams in lines 12 and 14 prior to introduction into the headbox 18 of the paper making machine 20.

EXAMPLE OF THE INVENTION

Operation of the process is described in the following example which are intended to be merely illustrative and the invention is not to be regarded as limited thereto.

EXAMPLE 1

Unbleached hardwood kraft pulp and unbleached softwood kraft pulp at a ratio of 90:10 parts are admixed and formed into a pulp sheet to form about a 90# 8.5 mil. saturating kraft sheet having the properties set forth in Table I below. Hycar 26322 (registered trademark of B. F. Goodrich), a carboxylated ethyl acrylate polymer emulsion is coated at 30% solids including red and yellow oxide pigments in a plurality of wire side followed by felt side operations and thence both sides coated simultaneously followed by a roller squeezing operation and final drying prior to rewinding at a pick-up rate of from 16 to 25# dry basis exhibiting the properties also set forth in Table I, below:

TABLE

| | RAW | HYCAR 26322 |
|---|---|---|
| Weight (#/ream) | 86.7 | 106 |
| Thickness (mils) | 8.5 | 9.1 |
| Tensile (#/in Md/Cd) | 38.75/20 | 61.5/30 |
| Elongation (% Md/Cd) | 2.75/3.5 | 5.0/8.5 |
| Delamination (ox/in) | 8.8 | 16.4 |
| Taber Stiffness | 54.8 | 42.0 |
| Tear (Elmeddorf Md/Cd) | 96/118 | 164/192 |
| MIT Fold Endurance | | |
| Smoothness (Sheffield) | | |
| Porosity (sec) | 14.1 | 309 |

The process and product of the present invention in a preferred form contemplates the use of substantially an all wood-based unbleached virgin fiber system of hardwood pulp and softwood pulp, it being understood, however, that minor amounts of bleached fiber may be present without affecting the quality of the final book cover. Additionally, while unrefined pulp is preferred, i.e. nonfibrillated pulp or pulp not subjected to some form of mechanical treatment to reduce fiber length, the saturant stock sheet may include the presence of fibrillated or highly refined bleached pulp of less than about 15 percent by weight.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

We claim:

1. A precursor sheet comprised of a stock sheet of from 70 to 95 parts unbleached hardwood fibers and 30 to 5 parts unbleached softwood fibers having a porosity of less than 35 seconds and an apparent density of from 7 to 14 impregnated with a saturant material having a $T_G$ of from 5° C. to −50° C. and comprising of from 5 to 50% by weight dry basis of said precursor sheet.

2. The precursor sheet as defined in claim 1 wherein said hardwood pulp fibers are obtained from chemical pulping of a hardwood selected from the group consisting of sweet gum, black gum, tupelo, red oak, scarlet oak, willow oak, water oak, laurel oak, white oak, swamp chestnut oak, red maple, yellow poplar, hickory and mixtures thereof.

3. The precursor sheet as defined in claim 1 or 2 wherein said softwood pulp fibers are obtained from chemical pulping of a softwood selected from the group consisting of loblolly pine, longleaf pine, slash pine, pond pine, shortleaf pine and mixtures thereof.

4. The precursor sheet as defined in claim 3 wherein said saturant is preferably present in an amount to provide 15 to 40 percent by weight dry basis of said precursor sheet.

5. The precursor sheet as defined in claim 1 or 2 is of a thickness of from 7 to 30 mils.

6. The precursor sheet as defined in claim 1 wherein said apparent density is preferably up from 9 to 12.

7. The precursor sheet as defined in claim 1 wherein said porosity is preferably up from 15 to 20 seconds.

8. The precursor sheet as defined in claim 1 wherein said saturant is in lattice form having a mean particle size of from 500 to 300 microns.

9. The precursor sheet as defined in claim 1 having a residual moisture of less than 5%.

* * * * *